United States Patent [19]

Washecheck

[11] 4,302,618

[45] Nov. 24, 1981

[54] TRACTION FLUID

[75] Inventor: Paul H. Washecheck, Ponca City, Okla.

[73] Assignee: Conoco Inc., Ponca City, Okla.

[21] Appl. No.: 143,977

[22] Filed: Apr. 28, 1980

Related U.S. Application Data

[63] Continuation-in-part of Ser. No. 23,574, Mar. 26, 1979, abandoned.

[51] Int. Cl.[3] ..... C10G 1/02; C10G 1/06

[52] U.S. Cl. ..... 585/1; 74/200; 74/215; 252/73; 585/25; 585/27

[58] Field of Search ..... 252/73; 74/200, 215; 585/1, 25, 27

[56] References Cited

U.S. PATENT DOCUMENTS

| | | | |
|---|---|---|---|
| 3,316,294 | 4/1967 | Feighner et al. | 260/660 X |
| 3,652,418 | 3/1972 | Wygant | 252/73 |
| 3,975,278 | 8/1976 | Wygant | 252/59 |

*Primary Examiner*—Delbert E. Gantz
*Assistant Examiner*—Irving Vaughn
*Attorney, Agent, or Firm*—Bayless E. Rutherford, Jr.

[57] ABSTRACT

A traction fluid is disclosed. The traction fluid is the product obtained by hydrogenation of a hydrocarbon composition containing at least 40 weight percent diphenylalkanes containing 22 to 34 carbon atoms.

12 Claims, No Drawings

TRACTION FLUID

CROSS-REFERENCE TO RELATED APPLICATIONS

The present application is a continuation-in-part of application Ser. No. 23,574, filed Mar. 26, 1979, abandoned.

FIELD OF THE INVENTION

The invention is in the general field of providing compositions useful as traction fluids.

GENERAL BACKGROUND

The following discussion of traction fluids is taken from U.S. Pat. No. 3,975,278.

"Traction is broadly defined as the adhesive friction of a body on the surface on which it moves. A tractive drive is a device in which torque is transmitted from an input element to an output element through nominal point or line contact typically with a rolling action by virtue of the traction between the contacting elements.

While tractive elements are commonly spoken of as being in contact, it is generally accepted that a fluid film is provided there between. Almost all tractive drives require fluids to remove heat, to prevent wear at the contact surfaces, and to lubricate bearings and other moving parts associated with the drive. Thus, instead of metal to metal rolling contact there is a film of fluid introduced into the load zone. The nature of this fluid determines to a large extent the limits of performance and the capability of the drive.

Many compositions have been suggested as tractive fluids, or tractants, for use in tractive drives with varying degrees of success. Some of these fluids are very efficient and effective tractants, but because of their relatively high cost have been restricted to specialty applications such as constant speed drives for aircraft generators. Other compositions are found to be unsuitable for low temperature operation due to high viscosity or a tendency to crystalize at temperatures of −20° F. or higher. In general, the tractive fluids heretofore have been expensive materials of limited application which required multicomponent blending and the use of additives in order to formulate compositions suitable for general use. For large volume utility applications, such as industrial drives and heavy duty vehicular drives for trucks and buses, less expensive fluids having a wide operable temperature range are sought."

I have found that the product obtained by hydrogenation of a hydrocarbon fraction containing at least 40 weight percent diphenylalkanes, containing 22 to 34 carbon atoms, has properties which make it useful as a traction fluid.

BRIEF SUMMARY OF THE INVENTION

Briefly stated, the present invention is directed to a traction fluid which comprises the product obtained by hydrogenation of a hydrocarbon composition containing at least 40 weight percent diphenylalkanes containing 22 to 34 carbon atoms, preferably 22 to 26 carbon atoms, said hydrocarbon composition having a boiling point in the range of about 300° to about 450° C. at atmospheric pressure.

DETAILED DESCRIPTION

The traction fluids of my invention are obtained by hydrogenation of a hydrocarbon composition containing at least 40 weight percent diphenylalkanes. Inasmuch as this hydrocarbon composition is a salient feature of my invention a complete description will be provided concerning it.

The diphenylalkanes in the composition of my invention can be represented by the formula

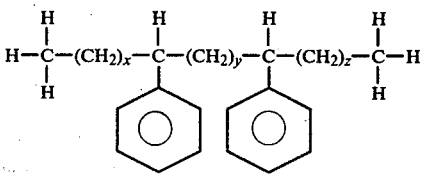

wherein x, y, and z are integers in the range of 0 to 14, preferably 0 to 10, with the sum of x, y, and z being in the range of 6 to 18, preferably 6 to 10. Preferably, the diphenylalkanes contain at least 5 weight percent of diphenylalkanes wherein x and z are 0.

Pure diphenylalkanes conforming to the foregoing description are particularly suitable for use in my invention.

Also, suitable for use in my invention are hydrocarbon compositions containing at least 40 weight percent, preferably at least 50 weight percent, more preferably at least 70 weight percent diphenylalkanes. The remaining hydrocarbons, which are primarily monoalkylbenzenes, dialkylbenzenes, and alkyltetrahydronaphthalenes, have a boiling range similar to the diphenylalkanes.

The hydrocarbon compositions subjected to hydrogenation have a boiling range of about 300° to about 450° C., preferably about 326° to about 400° C., and more preferably about 340° to about 400° C., at atmospheric pressure.

Broadly, compositions which are suitable for use in my invention, before hydrogenation, have the following composition:

Diphenylalkanes, 40–100%
Monoalkylbenzenes, 0–50%
Dialkylbenzenes, 0–40%
Miscellaneous Hydrocarbons, 0–30%

Preferably, the compositions, before hydrogenation, have the following composition:

Diphenylalkanes, 70–100%
Monoalkylbenzenes, 0–10%
Dialkylbenzenes, 0–15%
Miscellaneous Hydrocarbons, 0–20%

An example of a suitable hydrocarbon composition containing diphenylalkanes is a distillate by-product fraction from the preparation of mono-n-alkylbenzenes, such as disclosed by U.S. Pat. No. 3,316,294.

Briefly, U.S. Pat. No. 3,316,294 relates to a process of preparing a detergent alkylate, wherein the process comprises the following steps, broadly stated: (a) separating a fraction of substantially straight-chain $C_8$–$C_{18}$ hydrocarbons from a petroleum distillate substantially free of olefins and containing said straight-chain hydrocarbons together with non-straight chain hydrocarbons, (b) chlorinating said fraction to the extent whereby between about 10 and about 35 mole percent of the straight-chain hydrocarbons present are substantially only monochlorinated, (c) alkylating an aromatic compound, e.g. benzene, with the chlorination product of step (b) in the presence of an alkylation catalyst, and (d) recovering from the reaction mass, by distillation, a fraction consisting essentially of mono-n-alkylbenzenes.

The diphenylalkane fraction is the fraction distilling after the mono-n-alkylbenzenes. Typically, the diphenylalkane fraction has a boiling range of about 326° to about 400° C. at 760 mm. Hg. pressure. It contains about 50 weight percent diphenylalkanes, wherein the alkyl chain contains from 10 to 14 carbon atoms. Additionally, it contains about 35 weight percent mono-n-alkylbenzenes and 10 to 15 weight percent di-n-alkylbenzenes. The product can contain up to about 15 weight percent of miscellaneous hydrocarbons.

In a preferred embodiment of my invention the diphenylalkane fraction is subjected to a fractional distillation, with the material distilling in the 340° to 400° C. range being the desired fraction. This material is often referred to as the "heart-cut" fraction. By this process the bulk of monoalkylbenzenes, dialkylbenzenes, and similar boiling hydrocarbons is removed. Thus, the amount of diphenylalkanes is increased substantially.

The diphenylalkane-containing composition is hydrogenated using a standard procedure. It is hydrogenated to the point that the phenyl group is substantially converted to a cyclohexyl group. Knowing that the composition is to be hydrogenated any person skilled in the art can readily do this.

In order to provide a more complete disclosure a brief discussion will be provided of suitable hydrogenation procedures. Suitable hydrogenation catalysts include the metals of Group VI through Group VIII of the Periodic table, or their compounds, particularly their oxides, alone or in various mixtures with each other, or on carrier materials such as silica, zinc oxide, alumina, charcoal, kieselguhr, etc. A particularly suitable hydrogenation catalyst is nickel on an alumina carrier.

The reaction can take place at temperatures in the range of from about 50° to about 300° C., preferably about 175° to about 275° C., and pressures in the range of from about 100 to about 2,000 psig, preferably about 500 to about 1,000 psig.

The reaction preferably is conducted on a continuous basis. The amount of catalyst is governed by the relationship.

$$WHSV = \frac{\text{weight of liquid per hour}}{\text{weight of catalyst}}$$

On this basis a suitable range for WHSV is from about 0.2 to about 5.0. Preferably, the WHSV is from about 0.75 to about 1.5.

ADVANTAGES OF MY INVENTION

A review of the data presented in Table II, in the examples, shows that the "heart-cut" fraction is substantially equal to the best commercial product in 6 of 8 measurements. In the remaining two measurements (static loading) the "heart-cut" gives better values.

My hydrogenated product is prepared from a composition which has little commercial value. Thus, my invention provides a significant increase in the value of the product.

More importantly, alpha-methylstyrene has many uses. In some instances it would be desirable to use the alpha-methylstyrene to prepare products having a different, and, perhaps, more important utility.

Thus, use of my product as a traction fluid provides an important contribution to the overall chemical economy.

In order to illustrate the nature of the present invention still more clearly the following examples will be given. It is to be understood, however, that the invention is not to be limited to the specific conditions or details set forth in these examples except insofar as such limitations are specified in the appended claims.

EXAMPLE 1

This example illustrates the hydrogenation of a diphenylalkane-containing hydrocarbon composition. The composition contained approximately the following:

% Diphenylalkanes—45
% Monoalkylbenzenes—25
% Dialkylbenzenes—15
% Miscellaneous Hydrocarbons—15

It had the following physical properties:

| | |
|---|---|
| Average molecular weight | 310 |
| Pour Point, °F. | −70 |
| Viscosity, cs. | |
| 210° F. | 2.89 |
| 100° F. | 14.2 |
| 0° F. | 425 |
| −20° F. | 1640 |
| Viscosity Index | 32 |

One thousand grams of the composition was hydrogenated in a tubular reactor at 225° C., 800 psig and WHSV of 1 over a catalyst comprising 60 weight percent Ni on alumina. Analysis of the product by nuclear magnetic resonance indicated that hydrogenation was about 95 percent complete, i.e. greater than 95 percent of the aromatic rings were fully saturated. The hydrogenated product had the following physical properties:

| | |
|---|---|
| Pour Point, °F. | −50 |
| Viscosity, cs. | |
| 210° F. | 3.06 |
| 100° F. | 14.8 |
| 0° F. | 446 |
| −20° F. | 1500 |
| Viscosity Index | 58 |

EXAMPLE 2

The traction coefficient of the product of Example 1 was obtained by the test procedure and apparatus described by F. G. Rounds, Journal of Chemical and Engineering Data, Vol. 5, No. 4, pages 499–507 (1960) employing two steel thrust ball bearings and requiring 170 ml. of lubricant, by measuring the torque transmitted through the bearings as a function of load, speed and oil temperature.

Using the same procedure traction coefficients were obtained on two commercial products.

The results are shown in Table I.

TABLE I

| | | COEFFICIENT OF FRICTION (400,000 lb/in$^2$ Load) | | |
|---|---|---|---|---|
| | Sliding Speed | Commercial Oil "A" (1) | Commercial Oil "B" (2) | Product Example 1 |
| 200° F. | Static | 0.068 | 0.089 | 0.063 |
| | 250 ft/sec | 0.039 | 0.042 | 0.037 |
| | 500 ft/sec | 0.038 | 0.037 | 0.035 |
| | 750 ft/sec | 0.045 | 0.040 | 0.036 |
| 300° F. | Static | 0.067 | 0.076 | 0.074 |
| | 250 ft/sec | 0.046 | 0.049 | 0.039 |
| | 500 ft/sec | 0.041 | 0.039 | 0.038 |

TABLE I-continued

| COEFFICIENT OF FRICTION (400,000 lb/in$^2$ Load) | | | |
|---|---|---|---|
| Sliding Speed | Commercial Oil "A" (1) | Commercial Oil "B" (2) | Product Example 1 |
| 750 ft/sec | 0.044 | 0.037 | 0.040 |

(1) a hydrogenated alpha-methylstyrene dimer
(2) naphthenic oil

The above-listed data shows that the product of Example 1 was not quite as good as either commercial product at 200° F. At 300° F. the product of Example 1 was better than Commercial Oil "B" but still not as good as Commercial Oil "A".

EXAMPLE 3

The diphenylalkane-containing hydrocarbon composition of Example 1 was subjected to a fractional distillation, with the "heart-cut" being taken for further treatment. The heart-cut had a boiling range of 349° to 397° C. at atmospheric pressure. The composition contained approximately the following:

% Diphenylalkanes—75
% Monoalkylbenzenes—2
% Dialkylbenzenes—13
% Miscellaneous Hydrocarbons—10

It had the following physical properties:

| | |
|---|---|
| Average molecular weight | 363 |
| Pour Point, °F. | −60 |
| Viscosity, cs. | |
| 210° F. | 3.35 |
| 100° F. | 19.1 |
| 0° F. | 828 |
| −20° F. | 3080 |
| Viscosity Index | 22 |

One thousand grams of the composition was hydrogenated in a tubular reactor at 225° C., 800 psig and WHSV of 1 over a catalyst comprising 60 weight percent Ni on alumina. Analysis of the product by nuclear magnetic resonance indicated that hydrogenation was greater than 95 percent complete, i.e. greater than 95 percent of the aromatic rings were fully saturated. The hydrogenated product had the following physical properties:

| | |
|---|---|
| Pour Point, °F. | −50 |
| Viscosity, cs. | |
| 210° F. | 4.24 |
| 100° F. | 26.6 |
| 0° F. | 1500 |
| −20° F. | 6300 |
| Viscosity Index | 49 |

EXAMPLE 4

Using the procedures described in Example 2 the traction coefficient was obtained on the product of Example 3.

Traction coefficients were also obtained again on the product of Example 1 and on the two commercial products tested in Example 2.

The results are shown in Table II.

TABLE II

| COEFFICIENT OF FRICTION (400,000 lb/in$^2$ Load) | | | | | |
|---|---|---|---|---|---|
| | Sliding Speed | Commercial Oil "A" (1) | Commercial Oil "B" (2) | Prod. Ex. 1 | Prod. Ex. 3 |
| 200° F. | Static | 0.068 | 0.089 | 0.063 | 0.074 |
| | 100 ft/sec | 0.044 | 0.045 | 0.040 | 0.041 |
| | 500 ft/sec | 0.038 | 0.037 | 0.034 | 0.040 |
| | 800 ft/sec | 0.046 | 0.044 | 0.036 | 0.040 |
| 300° F. | Static | 0.067 | 0.076 | 0.074 | 0.082 |
| | 100 ft/sec | 0.044 | 0.057 | 0.044 | 0.045 |
| | 500 ft/sec | 0.041 | 0.039 | 0.038 | 0.040 |
| | 800 ft/sec | 0.045 | 0.038 | 0.040 | 0.044 |

(1) a hydrogenated alpha-methylstyrene dimer - (This is generally considered the best commercially available material)
(2) hydrogenated naphthenic oil Thus, having described the invention in detail, it will be understood by those skilled in the art that certain variations and modifications may be made without departing from the spirit and scope of the invention as defined herein and in the appended claims.

I claim:

1. A traction fluid composition which is the product obtained by hydrogenation of a hydrocarbon composition containing at least 40 weight percent diphenylalkanes said diphenylalkanes being represented by the formula

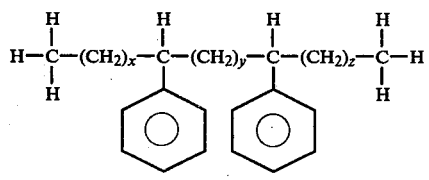

wherein x, y and z are integers in the range of 0 to 14, with the sum of x, y and z being in the range of 6 to 18, said diphenylalkanes being characterized further in that x and z are 0 in at least 5 weight percent thereof, the remaining hydrocarbons in said composition having a boiling range similar to the diphenylalkanes, said hydrocarbon composition having a boiling range of about 300° to 450° C. at atmospheric pressure.

2. The traction fluid composition of claim 1 wherein the sum of x, y and z is in the range of 6 to 10.

3. The traction fluid composition of claim 2 wherein the remaining hydrocarbons in said composition consist essentially of dialkylbenzenes, monoalkylbenzenes, and alkyltetrahydronaphthalenes.

4. The traction fluid composition of claim 3 wherein the hydrocarbon composition contains at least 70 weight percent diphenylalkanes.

5. The traction fluid composition of claim 4 wherein it contains about 75 weight percent diphenylalkanes, about 5 weight percent monoalkylbenzenes and about 20 weight percent dialkylbenzenes.

6. The traction fluid composition of claim 1 wherein the hydrocarbon composition contains the following:

Diphenylalkanes, 40–100%
Monoalkylbenzenes, 0–50%
Dialkylbenzenes, 0–40%
Miscellaneous Hydrocarbons, 0–20%.

7. The traction fluid composition of claim 1 where the hydrocarbon composition, which is hydrogenated, is prepared by a process comprising:

(a) separating a fraction of substantially straight-chain $C_8$–$C_{18}$ hydrocarbons from a petroleum distillate substantially free of olefins, (b) chlorinating said fraction to the extent whereby between about 10 and about 35 mole percent of the straight-chain hydrocarbons are substantially only monochlorinated, (c) alkylating benzene with the chlorination product of step (b) in the presence of an alkylation catalyst, (d) subjecting the product of step (c) to a fractional distillation whereby a fraction distilling in the range of about 300° to about 450° C. at atmospheric pressure is obtained, and, (e) subjecting the fraction distilling in the range of about 300° to about 450° C. to a further fractional distillation to obtain a fraction distilling in the range of about 340° to about 400° C. at atmospheric pressure.

8. The traction fluid composition of claim 1 where the hydrocarbon composition, which is hydrotreated, is prepared by a process comprising:

(a) separating a fraction of substantially straight-chain $C_{10}$–$C_{14}$ hydrocarbons from a petroleum distillate substantially free of olefins, (b) chlorinating said fraction to the extent whereby between about 20 mole percent of the straight-chain hydrocarbons are substantially only monochlorinated, (c) alkylating benzene with the chlorination product of step (b) in the presence of an alkylation catalyst, (d) subjecting the product of step (c) to a fractional distillation whereby a fraction distilling in the range of about 326° to about 400° C. at atmospheric pressure is obtained, and (e) subjecting the fraction distilling in the range of about 326° to about 400° C. to a further fractional distillation to obtain a fraction distilling in the range of about 349° C. to about 397° C. at atmospheric pressure.

9. A method of operating a tractive device wherein torque is transmitted between relatively rotatable members having tractive surfaces in a torque transmitting relationship and having a tractant disposed on said tractive surfaces, said method being characterized in that said tractant comprises the product obtained by hydrogenation of a hydrocarbon composition containing at least 40 weight percent diphenylalkanes, said diphenylalkanes being represented by the formula

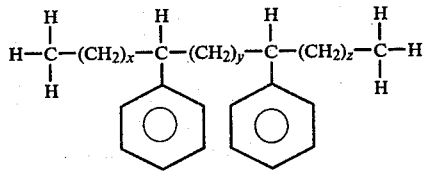

wherein x, y and z are integers in the range of 0 to 14, with the sum of x, y and z being in the range of 6 to 18, said diphenylalkanes being characterized further in that x and z are 0 in at least 5 weight percent thereof, the remaining hydrocarbons in said composition having a boiling range similar to the diphenylalkanes, said hydrocarbon composition having a boiling range of about 300° to about 450° C. at atmospheric pressure.

10. The method of claim 9 wherein the sum of x, y and z is in the range of 6 to 10.

11. The method of claim 10 wherein the remaining hydrocarbons in said hydrocarbon composition consists essentially of dialkylbenzenes, monoalkylbenzenes, and alkyltetrahydronaphthalenes.

12. The method of claim 11 wherein the hydrocarbon composition contains at least 70 weight percent diphenylalkanes.

* * * * *